US011097557B2

(12) United States Patent
Yoda

(10) Patent No.: US 11,097,557 B2
(45) Date of Patent: Aug. 24, 2021

(54) DRYING DEVICE AND LIQUID EJECTING DEVICE

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/777,359

(22) Filed: Jan. 30, 2020

(65) Prior Publication Data

US 2020/0247144 A1 Aug. 6, 2020

(30) Foreign Application Priority Data

Jan. 31, 2019 (JP) ..... JP2019-015324

(51) Int. Cl.
*B41J 11/00* (2006.01)
*B41J 13/10* (2006.01)

(52) U.S. Cl.
CPC ..... *B41J 11/002* (2013.01); *B41J 13/10* (2013.01)

(58) Field of Classification Search
CPC ..... B41J 11/002; B41J 13/10
See application file for complete search history.

(56) References Cited

U.S. PATENT DOCUMENTS 5,281,442 A * 1/1994 Fulton ..... B41M 5/0047 118/59
6,783,226 B2 * 8/2004 Szlucha ..... B41J 11/002 219/50
8,992,000 B2 3/2015 Sasaki
2014/0198147 A1 * 7/2014 Sasaki ..... B41J 11/0015 347/16

FOREIGN PATENT DOCUMENTS

JP 2015-024636 2/2015
JP 2018034412 A * 3/2018

* cited by examiner

*Primary Examiner* — Sharon Polk
(74) *Attorney, Agent, or Firm* — Workman Nydegger

(57) ABSTRACT

A drying device dries a medium being transported, the drying device including a support unit configured to support the medium, and a non-contact heater facing the support unit. The support unit includes a first support unit and a second support unit located at a position different from a position of the first support unit in a transport direction of the medium being transported, the medium bends along the second support unit, the first support unit is composed of an aluminum material, and the second support unit is composed of a material having a thermal expansion coefficient smaller than a thermal expansion coefficient of the aluminum material.

5 Claims, 3 Drawing Sheets

DRYING DEVICE AND LIQUID EJECTING DEVICE

The present application is based on, and claims priority from JP Application Serial Number 2019-015324, filed Jan. 31, 2019, the disclosure of which is hereby incorporated by reference herein in its entirety.

BACKGROUND

The present disclosure relates to a drying device and a liquid ejecting device.

JP-A-2015-24636 discloses a drying device including a support unit that supports a medium being transported, and an irradiation unit that irradiates the medium supported by the support unit with an infrared ray to dry the medium.

SUMMARY

In such a drying device, the support unit expands due to the heat from the irradiation unit in some situation. When the support unit expands, the shape of the support unit changes, and consequently the medium transported on the support unit obliquely tilts in some situation. When the medium obliquely tilts on the support unit, the medium may not possibly be appropriately transported.

The present disclosure is directed to the above-mentioned problem. A drying device, according to the present disclosure, dries a medium being transported, and includes a support unit configured to support the medium and a non-contact heater facing the support unit. The support unit includes a first support unit and a second support unit located at a position different from a position of the first support unit in a transport direction of the medium being transported, the medium bends along the second support unit, the first support unit is composed of an aluminum material, and the second support unit is composed of a material having a thermal expansion coefficient smaller than a thermal expansion coefficient of the aluminum material.

A liquid ejecting device, according to the present disclosure, includes a support unit configured to support a medium, a non-contact heater facing the support unit, and a transport unit configured to transport the medium. The support unit includes a first support unit and a second support unit located at a position different from a position of the first support unit in a transport direction of the medium being transported, the medium bends along the second support unit, the first support unit is composed of an aluminum material, and the second support unit is composed of a material having a thermal expansion coefficient smaller than a thermal expansion coefficient of the aluminum material.

DESCRIPTION OF EXEMPLARY EMBODIMENTS

A liquid ejecting device according to one embodiment is described below with reference to the drawings. The liquid ejecting device is, for example, an ink-jet printer that records an image such as characters and photographs on a medium such as a sheet by ejecting ink, which is an example of liquid.

Figure 1:
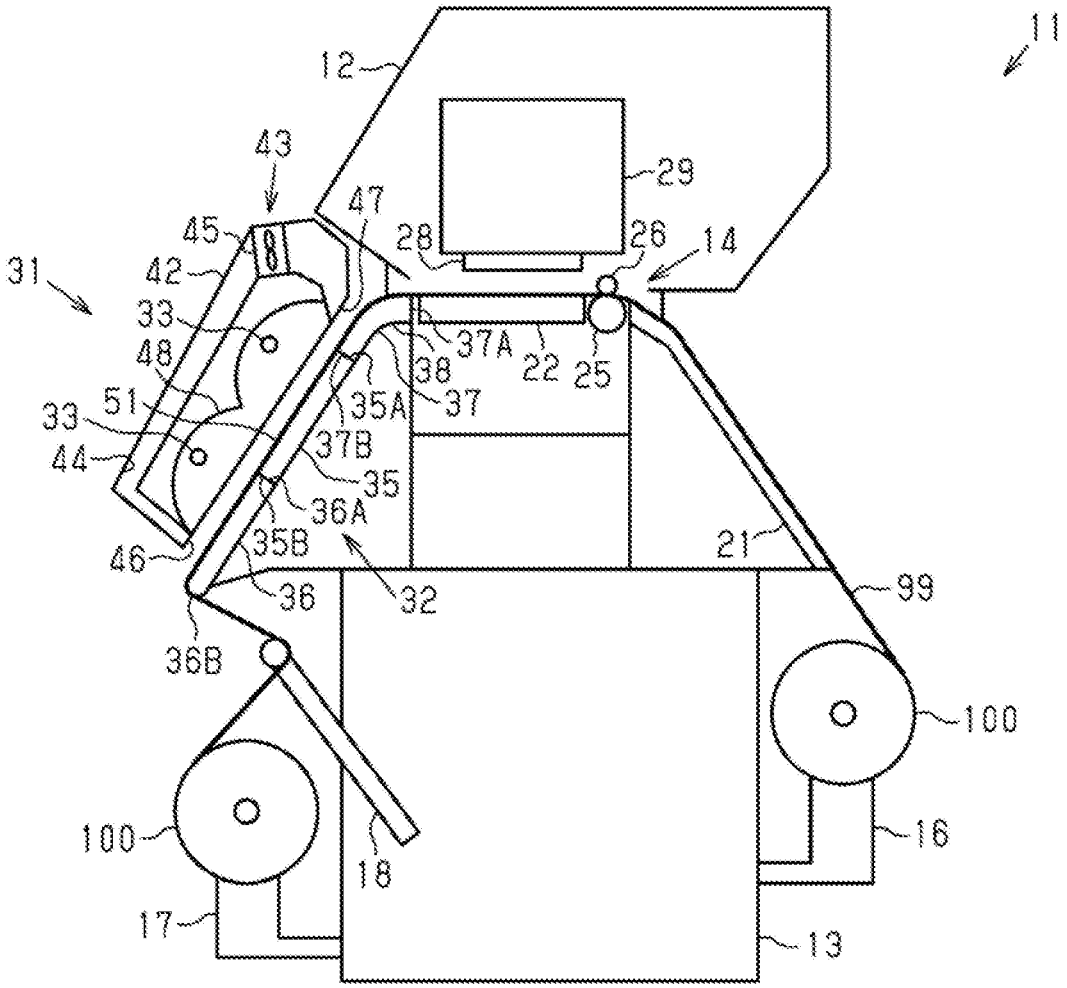
FIG. 1 is a side view schematically illustrating one embodiment of a liquid ejecting device including a drying device.

As illustrated in FIG. 1, a liquid ejecting device 11 includes an ejecting unit 28 that ejects liquid to a medium 99 being transported. The liquid ejecting device 11 includes a drying device 31 that dries the medium 99 being transported. The drying device 31 of the present embodiment dries the medium 99 to which liquid was ejected by the ejecting unit 28.

The liquid ejecting device 11 includes a housing 12. The liquid ejecting device 11 includes a base 13 that supports the housing 12. In the present embodiment, the housing 12 is located above the base 13.

The liquid ejecting device 11 includes a transport unit 14 that transports the medium 99. The transport unit 14 is provided inside the housing 12. The transport unit 14 of the present embodiment transports the medium 99 placed outside the housing 12.

The liquid ejecting device 11 may include a placement unit 16 on which a roll body 100 composed of the wound medium 99 can be placed. The placement unit 16 is attached to the base 13, for example. The placement unit 16 rotatably supports the roll body 100 composed of the wound medium 99 on which liquid has not yet been ejected. When the transport unit 14 is driven, the medium 99 is fed from the roll body 100.

The liquid ejecting device 11 may eject liquid to the medium 99 fed from the roll body 100 placed on an installation surface on which the liquid ejecting device 11 is provided. The liquid ejecting device 11 may eject liquid to the medium 99 fed from an apparatus other than the liquid ejecting device 11. For example, an apparatus other than the liquid ejecting device 11 may include the placement unit 16. The liquid ejecting device 11 is not limited to the configuration in which liquid is ejected to the medium 99 fed from the roll body 100. For example, the liquid ejecting device 11 may eject liquid to an elongated medium 99 such as a fanfold sheet.

The liquid ejecting device 11 may include a winding unit 17 that winds the medium 99. The winding unit 17 is attached to the base 13, for example. The winding unit 17 winds the medium 99 on which liquid has been ejected as the roll body 100. The winding unit 17 winds the medium 99 that has passed through the drying device 31. The liquid ejecting device 11 may transport the medium 99 on which liquid has been ejected to an apparatus other than the liquid ejecting device 11. For example, an apparatus other than the liquid ejecting device 11 may include the winding unit 17. The liquid ejecting device 11 may be configured to cause an apparatus other than the liquid ejecting device 11 to wind the medium 99 on which liquid has been ejected.

The liquid ejecting device 11 may include a tension applying member 18 that applies tension to the medium 99. The tension applying member 18 applies tension to the medium 99 by making contact with the medium 99. By applying tension to the medium 99 with the tension applying member 18, the liquid ejecting device 11 can accurately eject liquid to the medium 99. The tension applying member 18 of the present embodiment makes contact with the medium 99 at a portion that has passed through the drying device 31 in the medium 99.

The tension applying member 18 may be attached to the base 13, for example. The tension applying member 18 may be attached to the base 13 in a displaceable manner. In this manner, the amount of the tension applied to the medium 99 can be adjusted by displacing the tension applying member 18.

The tension applying member 18 may be displaced such that the tension applied to the medium 99 is constant. In this case, the tension applying member 18 is displaced in accordance with the speed at which the winding unit 17 winds the medium 99, for example.

An apparatus other than the liquid ejecting device 11 may apply tension to the medium 99. For example, an apparatus other than the liquid ejecting device 11 may include the tension applying member 18.

The liquid ejecting device 11 of the present embodiment includes a first support base 21 and a second support base 22. The first support base 21 and the second support base 22 support the medium 99 transported by the transport unit 14. In the transport direction in which the medium 99 is transported, the first support base 21 and the second support base 22 are located in this order. The second support base 22 is located inside the housing 12. Note that in the present embodiment, the direction in which the medium 99 is transported along the transport path is the transport direction.

The ejecting unit 28 is located inside the housing 12. The ejecting unit 28 of the present embodiment is located at a position facing the second support base 22. Thus, the ejecting unit 28 ejects liquid to the medium 99 supported by the second support base 22.

The liquid ejecting device 11 of the present embodiment includes a carriage 29 for mounting the ejecting unit 28. The carriage 29 performs scanning on the medium 99 being transported. That is, the liquid ejecting device 11 of the present embodiment is a serial printer in which the ejecting unit 28 performs scanning on the medium 99. The liquid ejecting device 11 may be a line printer in which the ejecting unit 28 has a long length.

The transport unit 14 of the present embodiment includes a first roller 25 and a second roller 26. The first roller 25 and the second roller 26 transport the medium 99 by rotating with the medium 99 sandwiched therebetween. The first roller 25 and the second roller 26 are located such that the medium 99 is sandwiched between the first support base 21 and the second support base 22 in the transport path 15.

Next, the drying device 31 is described.

The drying device 31 includes a support unit 32 that supports the medium 99, and an irradiation heater 33 serving as a non-contact heater facing the support unit 32. The support unit 32 of the present embodiment supports the medium 99 that is wound by the winding unit 17. The support unit 32 of the present embodiment supports the medium 99 to which tension is applied by the tension applying member 18. The support unit 32 of the present embodiment supports the medium 99 to which liquid is ejected by the ejecting unit 28. Note that, while the drying device 31 of the present embodiment includes the irradiation heater 33 serving as a non-contact heater, any heater facing the support unit 32 may be adopted. For example, a configuration may be adopted in which a heating unit is provided inside a circulation path 44 described later, and the heated air is sent from an air blowing port 47 described later.

The support unit 32 is composed of, for example, a metal. The support unit 32 includes a first support unit 35 and a second support unit 36 located at a position different from the first support unit 35 in the transport direction. The second support unit 36 of the present embodiment is located downstream from the first support unit 35 in the transport direction.

The first support unit 35 of the present embodiment is configured to be continuous with the second support unit 36. Thus, in the present embodiment, a downstream end 35B of the first support unit 35 is in contact with an upstream end 36A of the second support unit 36. The downstream end 35B refers to a downstream end of the first support unit 35 in the transport direction. The upstream end 36A refers to an upstream end of the second support unit 36 in the transport direction.

The medium 99 bends by making contact with the second support unit 36. Specifically, the medium 99 bends along the second support unit 36. The medium 99 bends at a downstream end 36B of the second support unit 36, for example. The downstream end 36B refers to a downstream end of the second support unit 36 in the transport direction. In the present embodiment, the medium 99 bends in such a manner as to wrap around the downstream end 36B of the second support unit 36. In the present specification, bending means simple turning, and includes curving.

In the present embodiment, the medium 99 bends at the downstream end 36B of the second support unit 36 when wound by the winding unit 17. In other words, the medium 99 is pulled when wound by the winding unit 17. At this time, the medium 99 makes contact with the downstream end 36B of the second support unit 36 in such a manner as to wrap around the downstream end 36B of the second support unit 36. As a result, the medium 99 bends at the downstream end 36B of the second support unit 36. In other words, the downstream end 36B of the second support unit 36 guides the medium 99 toward the winding unit 17. The medium 99 may be bent at the downstream end 36B of the second support unit 36 when transported to an apparatus other than the liquid ejecting device 11.

The tension applying member 18 of the present embodiment makes contact with the medium 99 so as to press it against the second support unit 36. As a result, the medium 99 bends along the downstream end 36B of the second support unit 36. The downstream end 36B of the second support unit 36 guides the medium 99 toward the tension applying member 18.

The support unit 32 of the present embodiment includes a third support unit 37. The third support unit 37 is located upstream of the first support unit 35 in the transport direction. That is, the third support unit 37, the first support unit 35, and the second support unit 36 are located in this order in the transport direction. Specifically, the third support unit 37 constitutes an upstream portion of the support unit 32, the first support unit 35 constitutes a midstream portion of the support unit 32, and the second support unit 36 constitutes a downstream portion of the support unit 32. In other words, the third support unit 37 is located downstream of the position where the liquid is ejected by the ejecting unit 28 in the transport direction.

The third support unit 37 of the present embodiment is configured to be continuous with the first support unit 35. Therefore, in the present embodiment, the downstream end 37B of the third support unit 37 is in contact with the upstream end 35A of the first support unit 35. The downstream end 37B refers to a downstream end of the third support unit 37 in the transport direction. The upstream end 35A refers to an upstream end of the first support unit 35 in the transport direction. The upstream end 37A of the third support unit 37 is located inside the housing 12. The upstream end 37A refers to an upstream end of the third support unit 37 in the transport direction.

The medium 99 bends by making contact with the third support unit 37. Specifically, the medium 99 bends along the third support unit 37. The third support unit 37 of the present embodiment includes a bent portion 38 in a bent shape. Thus, the medium 99 supported by the third support unit 37 bends along the bent portion 38. The medium 99 bends in such a manner as to wrap around the bent portion 38 of the third support unit 37.

The bent portion 38 is located in the third support unit 37. The bent portion 38 is closer to the upstream end 37A than the downstream end 37B in the transport path between the upstream end 37A and the downstream end 37B. In other words, the distance between the upstream end 37A and the bent portion 38 is shorter than the distance between the downstream end 37B and the bent portion 38 on the transport path. In the present embodiment, the first support unit 35 and the second support unit 36 support the medium 99 in a flat state whereas the third support unit 37 supports the medium 99 in a bent state.

The medium 99 is bent at the bent portion 38 of the third support unit 37 and the downstream end 36B of the second support unit 36. When the medium 99 bends, the transport direction of the medium 99 changes. In the present embodiment, when the medium 99 bends at the bent portion 38, the transport direction of the medium 99 changes from the direction along the second support base 22 to the direction along the first support unit 35. When the medium 99 bends at the downstream end 36B of the second support unit 36, the transport direction of the medium 99 changes from the direction along the first support unit 35 to the direction toward the tension applying member 18 from the downstream end 36B of the second support unit 36.

The irradiation heater 33 emits an infrared ray toward the support unit 32. The irradiation heater 33 heats the support unit 32 and the medium 99 supported by the support unit 32. Thus, the medium 99 is heated when transported on the support unit 32. As a result, the medium 99 is dried.

The irradiation heater 33 of the present embodiment is composed of a heater tube. The irradiation heater 33 is disposed at a location facing a surface of the support unit 32 that makes contact with the medium 99 in the support unit 32. The irradiation heater 33 is elongated in the width direction of the medium 99 being transported.

The drying device 31 of the present embodiment includes two irradiation heaters 33. The two irradiation heaters 33 are located in postures parallel to each other. The two irradiation heaters 33 are located along the support unit 32.

The drying device 31 of the present embodiment includes a case 42 that houses the irradiation heater 33 and a circulation unit 43 that circulates gas inside the case 42. The case 42 is located such that the opening of the case 42 faces the surface of the support unit 32.

The circulation unit 43 includes the circulation path 44 through which gas flows, and a fan 45 located in the circulation path 41. The circulation path 44 is a flow path connecting between an intake port 46 that introduces gas and the air blowing port 47 that sends out gas. The circulation path 44 extends in such a manner as to surround the third support unit 37. The intake port 46 is disposed at a location facing the second support unit 36. The air blowing port 47 is disposed at a location facing the third support unit 37. The circulation unit 43 circulates the gas heated by the irradiation heater 33 inside the case 42. Thus, drying of the medium 99 is facilitated.

The drying device 31 may include a reflecting plate 48 that reflects the heat of the irradiation heater 33 toward the support unit 32. In this manner, the medium 99 supported by the support unit 32 can be effectively heated by the irradiation heater 33.

The first support unit 35 is composed of an aluminum material. Generally, aluminum materials have high thermal conductivity. As a result, the first support unit 35 is easily warmed by the heat of the irradiation heater 33. Thus, the medium 99 supported by the first support unit 35 can be effectively heated.

The aluminum material is a material defined as JIS H 4000, for example. The first support unit 35 of the present embodiment is composed of a material called A5052P. With the first support unit 35 composed of a material having a high thermal conductivity, the medium 99 can be effectively heated at the first support unit 35.

In addition, when the first support unit 35 is composed of a member having a high thermal conductivity, temperature variation of the medium 99 in the width direction is less likely to occur in comparison with a case where the first support unit 35 is composed of a member having a low thermal conductivity. Generally, the thermal capacity of the support unit 32 composed of a metal is greater than the thermal capacity of the medium 99, and therefore, when the medium 99 and the support unit 32 are heated by the irradiation heater 33 in the same manner, the temperature of the support unit 32 is lower than the temperature of the medium 99. In addition, when the medium 99 is transported on the support unit 32, the heat emitted from the irradiation heater 33 is blocked by the medium 99 in a region where the medium 99 passes in the support unit 32, and accordingly the medium 99 has a temperature higher than that of the support unit 32. Therefore, the heat is transferred from the medium 99 to the first support unit 35, and the temperature easily drops especially at an end of the medium 99 in the width direction where heat is easily transferred. Thus, in the medium 99, the temperature of the end portion is lower than the temperature of the central portion.

When there is a temperature variation in the medium 99, heat damage may possibly occur at a high temperature portion, and drying may possibly be insufficient at a low temperature portion. Therefore, it is preferable that temperature variation in the medium 99 be small. In this regard, when the first support unit 35 is composed of a member having a high thermal conductivity, the heat is easily transferred also from the central portion of the medium 99 having a relatively high temperature, and the heat is easily transferred inside the first support unit 35, and thus, the difference between the temperature of the central portion of the medium 99 and the temperature of the end portion of the medium 99 tends to be small. As a result, the temperature variation of the medium 99 in the width direction tends to be small.

The drying device 31 facilitates the drying of the medium 99 transported on the support unit 32 especially in the region over the first support unit 35. Therefore, the first support unit 35 is preferably composed of a material having a high radiation rate. In this regard, the aluminum material provides a high radiation rate when an oxide film is formed on the surface thereof.

When the first support unit 35 is composed of an aluminum material having a high radiation rate, the first support unit 35 can be quickly heated by the irradiation heater 33. In other words, with the high radiation rate, the first support unit 35 effectively absorbs the infrared ray from the irradiation heater 33. As a result, the first support unit 35 is quickly warmed. When the first support unit 35 is composed of an aluminum material, the warm-up time required for operating the drying device 31 can be shortened.

When the first support unit 35 is composed of an aluminum material having a high radiation rate, the temperature variation in the width direction of the medium 99 can be reduced. When the first support unit 35 is composed of an aluminum material having a high radiation rate, the temperature difference between the medium 99 and the support unit 32 is reduced. When the medium 99 is paper for example, the medium 99 has a high radiation rate. When the first support unit 35 is composed of an aluminum material, the first support unit 35 has a high radiation rate. Thus, the medium 99 and the first support unit 35 effectively absorb the infrared ray from the irradiation heater 33. As a result, the temperature difference between the medium 99 and the first support unit 35 is reduced. As a result, the temperature drop at the end of the medium 99 less likely to occur, and the temperature variation in the medium 99 in the width direction is reduced. If the first support unit 35 is composed of a material having a low radiation rate, the temperature difference between the medium 99 and the first support unit 35 tends to be large.

A surface 51 of the first support unit 35 of the present embodiment is anodized. When the surface 51 of the first support unit 35 is anodized, the radiation rate of the first support unit 35 is improved. Thus, the drying of the medium 99 can be facilitated.

In some situation, the support unit 32 expands due to the heating by the irradiation heater 33. When the support unit 32 expands, the posture of the medium 99 transported on the support unit 32 may possibly change. In particular, when the second support unit 36 that bends the medium 99 expands, the shape of the second support unit 36 changes, and consequently the posture of the medium 99 transported on the support unit 32 may possibly change. The medium 99 bends along the downstream end 36B of the second support unit 36. That is, the medium 99 strongly makes contact with the downstream end 36B of the second support unit 36. Thus, the shape of the downstream end 36B of the second support unit 36 affects the posture of the medium 99.

Expansion of the second support unit 36 results in a change in the path length, which is the distance from the position where the transport unit 14 sandwiches the medium 99 to the downstream end 36B of the second support unit 36. At this time, when the path length changes in the width direction of the medium 99, the medium 99 tends to obliquely tilt on the support unit 32.

In the present embodiment, when the third support unit 37 including the bent portion 38 expands, the shape of the third support unit 37 changes, and consequently the posture of the medium 99 transported on the support unit 32 may possibly change. The medium 99 bends along the bent portion 38. That is, the medium 99 strongly makes contact with the bent portion 38 of the third support unit 37. As a result, the shape of the bent portion 38 of the third support unit 37 affects the posture of the medium 99.

Expansion of the third support unit 37 results in a change in the path length, which is the distance from the position where the transport unit 14 sandwiches the medium 99 to the bent portion 38. At this time, when the path length changes in the width direction of the medium 99, the medium 99 tends to obliquely tilt on the support unit 32.

As described above, the posture of the medium 99 is easily affected by the expansion of the second support unit 36 and the third support unit 37 that support the medium 99 in a bending manner, in the support unit 32. Therefore, when the second support unit 36 or the third support unit 37 expands, the medium 99 transported on the support unit 32 may possibly obliquely tilt. The first support unit 35 merely supports the medium 99 being transported in a flat state and does not make contact with the medium 99 in such a manner as to bend the medium 99, and therefore, even if the first support unit 35 expands, the expansion does not significantly affect the posture of the medium 99.

The aluminum material constituting the first support unit 35 is a material having a high thermal expansion coefficient although having a high thermal conductivity and a high radiation rate. Therefore, when the second support unit 36 is composed of an aluminum material having a high thermal expansion coefficient, the second support unit 36 easily expand due to the heating by the irradiation heater 33. When the second support unit 36 expands, the medium 99 may possibly obliquely tilt.

The thermal expansion coefficient varies depending on the temperature range. In the present specification, the thermal expansion coefficient of any of the members is the average thermal expansion coefficient in the temperature range of the heating of the irradiation heater 33. The irradiation heater 33 operates in a temperature range from 60° C. to 100° C., for example. In this case, the thermal expansion coefficient of any of the members in the present embodiment is an average value in the temperature range from 60° C. to 100° C.

Figure 2:
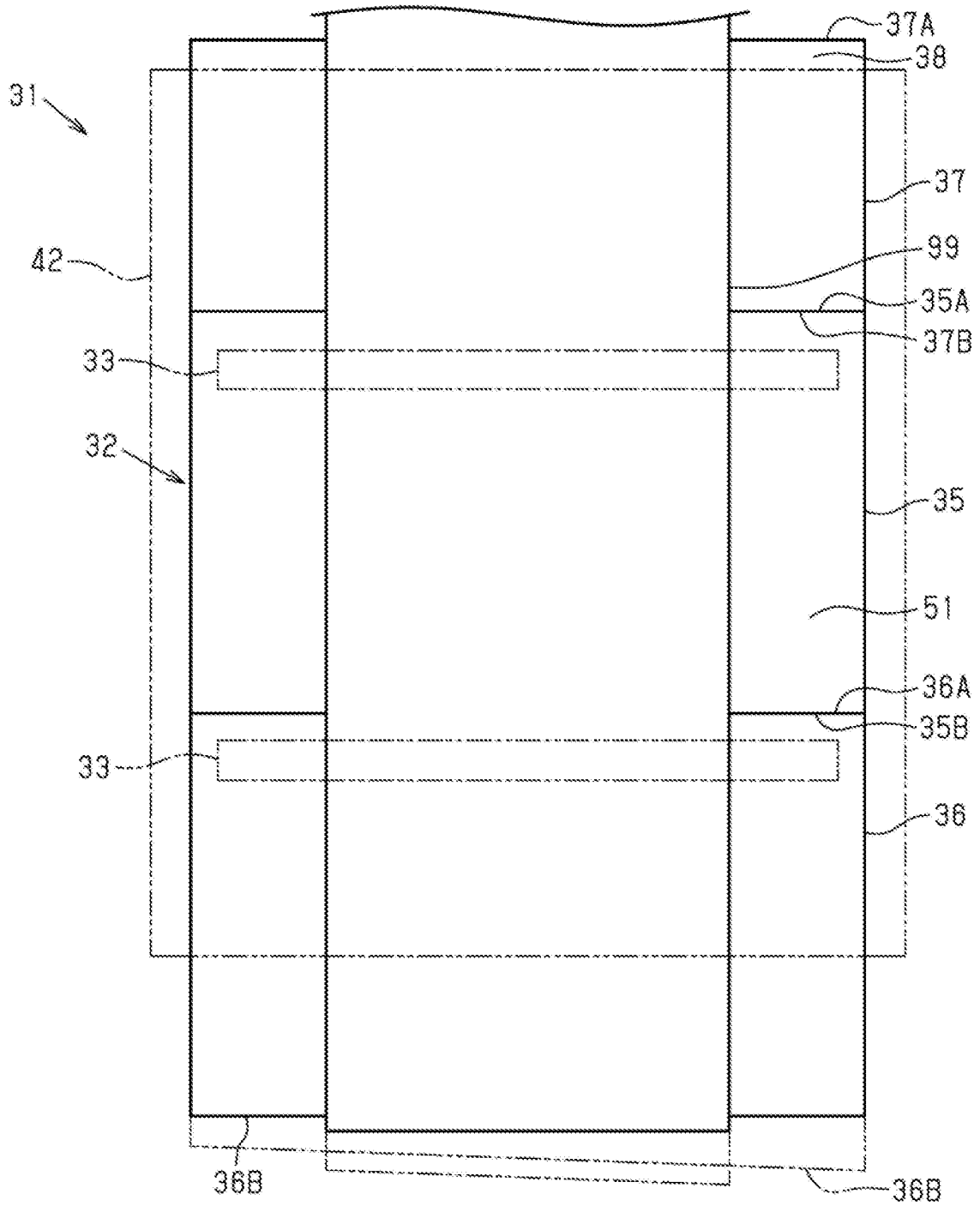
FIG. 2 is a top view of a drying device.

As illustrated in FIG. 2, for example, when the second support unit 36 expands due to the heat of the irradiation heater 33, the shape of the downstream end 36B of the second support unit 36 is inclined as indicated by the two-dot chain line in some situation. In this case, the medium 99 may possibly obliquely tilt in accordance with the shape of the downstream end 36B of the second support unit 36. In the second support unit 36 of the present embodiment, the upstream end 36A is in contact with the downstream end 35B of the first support unit 35, and as such a change in shape due to the expansion tends to occur at the downstream end 36B. Therefore, the second support unit 36 is composed of a material having a thermal expansion coefficient smaller than that of the aluminum material. As a result, the second support unit 36 is less likely to be expanded in comparison with the first support unit 35. With the second support unit 36 that is less likely to be expanded, the possibility of the tilting of the medium 99 transported on the support unit 32 can be reduced.

The second support unit 36 of the present embodiment is composed of a SUS material. Generally, the thermal expansion coefficient of a SUS material is smaller than the thermal expansion coefficient of an aluminum material. The second support unit 36 is composed of SUS304, for example.

When the third support unit 37 expands due to the heat of the irradiation heater 33, the shape of the bent portion 38 is tilted in some situation. In this case, the medium 99 may possibly obliquely tilt in accordance with the shape of the bent portion 38. In the third support unit 37 of the present embodiment, the downstream end 37B is in contact with the upstream end 35A of the first support unit 35, and as such a change in shape due to the expansion tends to occur at the upstream end 37A. As a result, the shape of the bent portion 38 located near the upstream end 37A tends to change.

The third support unit 37 of the present embodiment is composed of a material having a thermal expansion coefficient smaller than that of the aluminum material. Thus, the third support unit 37 is less likely to be expanded in comparison with the first support unit 35. With the third support unit 37 that is less likely to be expanded, the possibility of the tilting of the medium 99 transported on the support unit 32 can be reduced. The third support unit 37 is composed of a material identical to that of the second support unit 36, for example. Therefore, the third support unit 37 is composed of a SUS material. The third support unit 37 is composed of SUS304.

The second support unit 36 of the present embodiment is located downstream from the first support unit 35 and upstream from the winding unit 17 in the transport direction. Thus, by reducing the possibility of the tilting of the medium 99 being transported, the risk of a situation where the tilted medium 99 is wound by the winding unit 17 can be reduced.

The second support unit 36 of the present embodiment is located downstream from the first support unit 35 and upstream from the position where the tension applying member 18 makes contact with the medium 99 in the transport direction. In this manner, when tension is applied to the medium 99 by the tension applying member 18, the possibility of the tilting of the medium 99 being transported can be reduced.

When the medium 99 is pressed against the second support unit 36 by the tension applying member 18, the medium 99 tends to be further obliquely tilted due to expansion of the second support unit 36. In view of this, by configuring the second support unit 36 with a material having a high thermal expansion coefficient, it is possible to reduce the risk of a situation where the change in posture of the medium 99 is facilitated when the tension applying member 18 presses the medium 99 against the second support unit 36.

Next, the functions and effects of the embodiment are described.

The medium 99 bends along the second support unit 36. As such, when the second support unit 36 expands due to the heating of the irradiation heater 33, the posture of the medium 99 transported on the support unit 32 may possibly change due to a change in shape of the second support unit 36. As a result, the medium 99 being transported may possibly obliquely tilt. In contrast, the first support unit 35 is composed of an aluminum material having a high thermal conductivity and a high radiation rate for the purpose of facilitating the drying of the medium 99. On the other hand, the second support unit 36 is composed of a material having a thermal expansion coefficient smaller than that of the aluminum material. In other words, the second support unit 36 is less likely to be expanded in comparison with the first support unit 35. Thus, the possibility of the tilting of the medium 99 on the support unit 32 can be reduced.

The second support unit 36 is located downstream from the first support unit 35 and upstream from the winding unit 17 in the transport direction. In this case, the risk of a situation where the tilted medium 99 is wound by the winding unit 17 can be reduced.

The second support unit 36 is located downstream from the first support unit 35 and upstream from the position where the tension applying member 18 makes contact with the medium 99 in the transport direction. When the medium 99 is pressed against the second support unit 36 by the tension applying member 18, the medium 99 tends to be further obliquely tilted due to expansion of the second support unit 36. In this regard, according to the above-described embodiment, when tension is applied to the medium 99 by the tension applying member 18, the possibility of the tilting of the medium 99 being transported can be reduced.

The medium 99 bends by making contact with the third support unit 37. As such, when the third support unit 37 expands due to the heating of the irradiation heater 33, the posture of the medium 99 transported on the support unit 32 may possibly change due to a change in a shape of the third support unit 37. As a result, the medium 99 being transported may possibly obliquely tilt. In view of this, the third support unit 37 is composed of a member having a thermal expansion coefficient smaller than that of the aluminum material. In other words, the third support unit 37 is less likely to be expanded in comparison with the first support unit 35. Thus, the possibility of the tilting of the medium 99 being transported can be reduced. By reducing the possibility of the tilting of the medium 99 between the ejecting unit 28 and the third support unit 37, the risk of deviation of the hitting position of the liquid ejected by the ejecting unit 28 with respect to the medium 99 can be reduced.

The surface 51 that makes contact with the medium 99 in the first support unit 35 is anodized. By providing anodization, the radiation rate of the first support unit 35 is improved. In other words, the first support unit 35 is easily warmed, and thus the drying of the medium 99 can be facilitated.

The present embodiment may be modified as follows. The present embodiment and the following modification may be implemented in combination within a range in which a technical contradiction does not arise.

Figure 3:
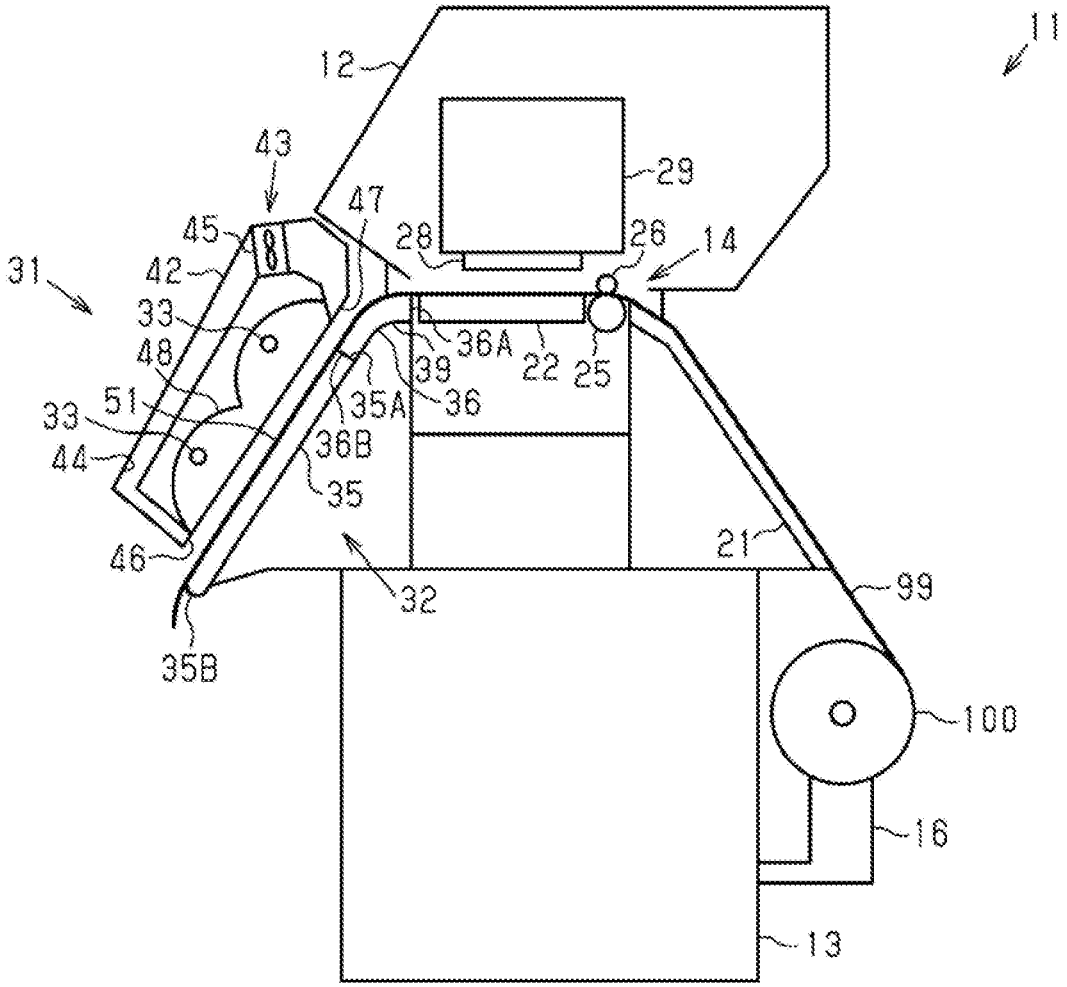
FIG. 3 is a side view of a liquid ejecting device including a drying device including a modified support unit.

As illustrated in FIG. 3, the second support unit 36 may be located upstream from the first support unit 35 in the transport direction. In this case, the second support unit 36 is located downstream from the position where the liquid is ejected by the ejecting unit 28 in the transport direction.

The second support unit 36 of this modified example is composed of a material, such as a SUS material, having a thermal expansion coefficient higher than that of an aluminum material, and includes a bent portion 39. The medium 99 transported on the support unit 32 is bent at the bent portion 39 of the second support unit 36. The medium 99 that has passed through the drying device 31 is transported toward the installation surface on which the liquid ejecting device 11 is installed.

According to the modification, the following effects can be achieved.

The possibility of the tilting of the medium 99 between the ejecting unit 28 and the second support unit 36 can be reduced. Thus, the liquid can accurately hit the medium 99. As a result, a high-quality image can be recorded on the medium 99.

The medium 99 is not limited to a long sheet fed from the roll body 100, and may be a single-cut sheet. The medium 99 is not limited to paper, and may be a fabric.

The liquid ejected by the ejecting unit 28 is not limited to ink, and may be, for example, a liquid material containing particles of a functional material dispersed or mixed in liquid. For example, the ejecting unit 28 may eject a liquid material including a dispersed or dissolved material such as a pixel material or an electrode material used in manufacture of a liquid crystal display, an electroluminescent (EL) display, a surface emitting display and the like.

The technical concepts and effects thereof that are understood from the above-described embodiment and modification are described below.

A drying device dries a medium being transported, and includes a support unit configured to support the medium, and a non-contact heater facing the support unit. The support unit includes a first support unit and a second support unit located at a position different from a position of the first support unit in a transport direction of the medium being transported, the medium bends along the second support unit, the first support unit is composed of an aluminum material, and the second support unit is composed of a material having a thermal expansion coefficient smaller than that of the aluminum material.

The medium bends along the second support unit. As such, when the second support unit expands due to the heating of the irradiation heater, the posture of the medium transported on the support unit may possibly change due to a change in shape of the second support unit. As a result, the medium being transported may possibly obliquely tilt. In view of this, the first support unit is composed of an aluminum material having a high thermal conductivity and a high radiation rate for the purpose of facilitating drying of the medium. On the other hand, the second support unit is composed of a material having a thermal expansion coefficient smaller than that of the aluminum material. In other words, the second support unit is less likely to be expanded in comparison with the first support unit. Accordingly, the possibility of the tilting of the medium on the support unit can be reduced.

In the drying device described above, the support unit may support the medium to be wound by the winding unit, and the second support unit may be located downstream from the first support unit and upstream from the winding unit in the transport direction.

With this configuration, the risk of a situation where the winding unit wounds the tilted medium can be reduced.

In the drying device, the support unit may support the medium to which tension is applied by a tension applying member, the tension applying member may make contact with the medium so as to press the medium against the second support unit, and the second support unit may be, in the transport direction, located downstream from the first support unit and upstream from a position where the tension applying member makes contact with the medium.

When the medium is pressed against the second support unit by the tension applying member, the medium tends to be further obliquely tilted due to expansion of the second support unit. In this regard, with the above-described configuration, when tension is applied to the medium by the tension applying member, the possibility of the tilting of the medium being transported can be reduced.

In the drying device, the support unit may support the medium to which liquid was ejected by an ejecting unit, and the second support unit may be located, in the transport direction, upstream from the first support unit and downstream from a position where the liquid is ejected by the ejecting unit.

With this configuration, the possibility of the tilting of the medium between the ejecting unit and the second support unit can be reduced.

In the drying device, the support unit configured to support the medium to which liquid was ejected by an ejecting unit may include a third support unit located, in the transport direction, upstream from the first support unit and downstream from a position where the liquid is ejected by the ejecting unit, the medium may bend by making contact with the third support unit, and the third support unit may be composed of a material having a thermal expansion coefficient smaller than that of the aluminum material.

The medium bends by making contact with the third support unit. As such, when the third support unit expands due to the heating of the irradiation heater, the posture of the medium transported on the support unit may possibly change due to a change in shape of the third support unit. As a result, the medium being transported may possibly obliquely tilt. In view of this, the third support unit is composed of a member having a thermal expansion coefficient smaller than that of the aluminum material. In other words, the third support unit is less likely to be expanded in comparison with the first support unit. Thus, the possibility of the tilting of the medium being transported can be reduced. By reducing the possibility of the tilting of the medium between the ejecting unit and the third support unit, the risk of deviation of the hitting position of the liquid ejected by the ejecting unit with respect to the medium can be reduced.

In the drying device, a surface of the first support unit may be anodized, the surface being a surface that makes contact with the medium.

By providing anodization, the radiation rate of the first support unit is improved. In other words, drying of the medium can be facilitated since the first support unit is easily warmed.

The liquid ejecting device includes a support unit configured to support a medium, a non-contact heater facing the support unit, and a transport unit configured to transport the medium. The support unit includes a first support unit and a second support unit located at a position different from a position of the first support unit in a transport direction of the medium being transported, the medium bends along the second support unit, the first support unit is composed of an aluminum material, and the second support unit is composed of a material having a thermal expansion coefficient smaller than that of the aluminum material.

With this configuration, the same effect as the above-described drying device can be achieved.

What is claimed is:

1. A drying device for drying a medium being transported, the drying device comprising:

a support unit configured to support the medium; and a non-contact heater facing the support unit; wherein the support unit includes a first support unit and a second support unit located at a position different from a position of the first support unit in a transport direction of the medium being transported;

the medium bends along the second support unit;

the first support unit is composed of an aluminum material; and the second support unit is composed of a material having a thermal expansion coefficient smaller than a thermal expansion coefficient of the aluminum material;

the support unit supports the medium to which tension is applied by a tension applying member;

the tension applying member makes contact with the medium to press the medium against the second support unit; and the second support unit is located, in the transport direction, downstream from the first support unit and upstream from a position where the tension applying member makes contact with the medium.

2. The drying device according to claim 1, wherein the support unit supports the medium to be wound by a winding unit.

3. The drying device according to claim 2, wherein the support unit configured to support the medium to which liquid was ejected by an ejecting unit includes a third support unit located, in the transport direction, upstream from the first support unit and downstream from a position where the liquid is ejected by the ejecting unit;

the medium bends along the third support unit; and the third support unit is composed of a material having a thermal expansion coefficient smaller than a thermal expansion coefficient of the aluminum material.

4. A drying device for drying a medium being transported, the drying device comprising:

a support unit configured to support the medium; and a non-contact heater facing the support unit; wherein the support unit includes a first support unit and a second support unit located at a position different from a position of the first support unit in a transport direction of the medium being transported;

the medium bends along the second support unit;

the first support unit is composed of an aluminum material; and the second support unit is composed of a material having a thermal expansion coefficient smaller than a thermal expansion coefficient of the aluminum material;

the support unit supports the medium to which liquid was ejected by an ejecting unit; and the second support unit is located, in the transport direction, upstream from the first support unit and downstream from a position where the liquid is ejected by the ejecting unit.

5. A drying device for drying a medium being transported, the drying device comprising:

a support unit configured to support the medium; and a non-contact heater facing the support unit; wherein the support unit includes a first support unit and a second support unit located at a position different from a position of the first support unit in a transport direction of the medium being transported;

the medium bends along the second support unit;

the first support unit is composed of an aluminum material;

the second support unit is composed of a material having a thermal expansion coefficient smaller than a thermal expansion coefficient of the aluminum material; and a surface, of the first support unit, that makes contact with the medium is anodized.

* * * * *